United States Patent [19]

Jamin

[11] 3,984,150

[45] Oct. 5, 1976

[54] SEALING APPARATUS

[75] Inventor: Guillaume Ward Jamin, Manchester, England

[73] Assignee: Imperial Chemical Industries Limited, London, England

[22] Filed: Oct. 20, 1975

[21] Appl. No.: 623,925

[30] Foreign Application Priority Data

Nov. 4, 1974 United Kingdom ..... 47604/74

[52] U.S. Cl. ..... 308/3.5

[51] Int. Cl.[2] ..... F16C 33/72

[58] Field of Search ..... 308/3.5; 226/97, 181; 34/92, 242; 68/5 E

[56] References Cited

UNITED STATES PATENTS

| | | | |
|---|---|---|---|
| 3,638,845 | 2/1972 | Herzhott et al. | 226/97 |
| 3,920,287 | 11/1975 | Jamin | 308/3.5 |

*Primary Examiner*—M. H. Wood, Jr.
*Assistant Examiner*—Gene A. Church
*Attorney, Agent, or Firm*—Cushman, Darby & Cushman

[57] ABSTRACT

An improved sealing apparatus for permitting the continuous passage of a web material through a gap in a wall separating two zones at different pressures while minimizing the flow of air from one zone to the other.

1 Claim, 3 Drawing Figures

FIGURE 1

SEALING APPARATUS

Figure 1:
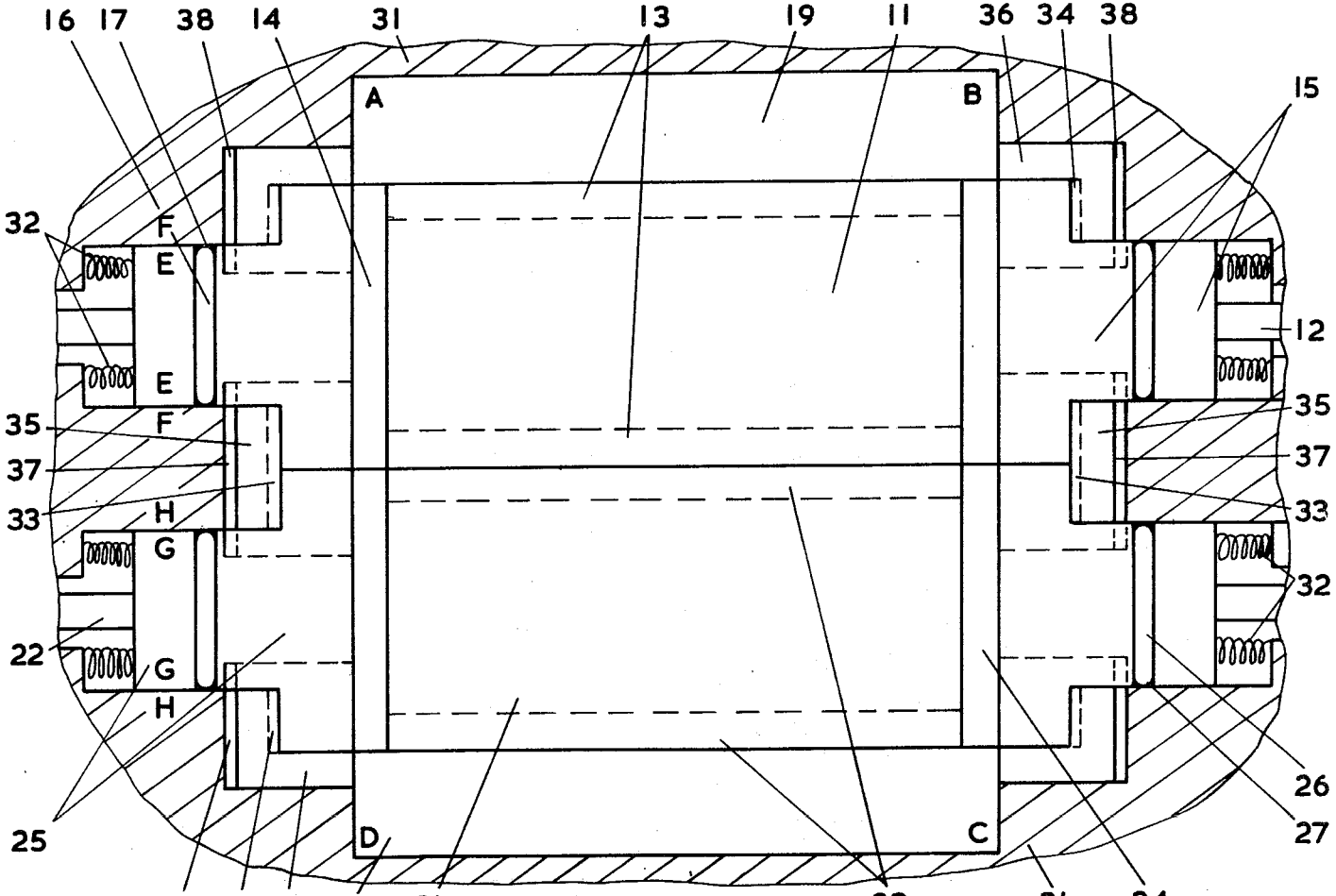

This invention relates to an improved seal which enables a textile material to be transferred across a pressure differential whilst minimising the flow of air through the seal.

In U.S. patent application Ser. No. 475,913 now U.S. Pat. No. 3,920,287 there is described and claimed a sealing apparatus for permitting continuous passage of a web material through a gap in a wall separating two zones at different pressures while minimizing the flow of air from one zone to the other, comprising a. first and second bearing members between which the web material passes, said bearing members being built into the gap, the first bearing member comprising a cylindrical roller rotatable about a longitudinal axle and the second bearing member comprising a cylindrical roller rotatable about a longitudinal axle which is parallel to the axle of the first bearing member and which roller comprises a solid cylindrical core the lateral face of which is covered by a layer of compressible material, the distance between the two longitudinal axles being such that the two cylindrical rollers are maintained in contact, b. first sealing means provided between the lateral faces of both bearing members and edges of the gap adjacent thereto, and c. second sealing means provided between the end faces of both bearing members and edges of the gap adjacent thereto, said second sealing means comprising a plate disposed on each side of said bearing members between the end faces of said bearing members and the gap edges adjacent thereto, and a plurality of springs for biasing each plate into contact with the corresponding end faces of said bearing members throughout the length of said end faces.

This arrangement produces an effective seal provided that the two end faces of the bearing members are exactly coplanar and also that the wear plate wears evenly. If either or both of these two conditions are not met then there can be substantial leakage of air between the wear plate and the end faces of the bearing members.

Such leakage can be reduced by providing an individual wear member for each end face of each bearing member and then sealing these to each other and to the opposed edge of the gap in such a way that the wear members can move independently and that there is no leakage path between adjacent wear members or between each wear member and the opposed edge of the gap.

According to the present invention I provide an improved sealing apparatus for permitting the continuous passage of a web material through a gap in a wall separating two zones at different pressures while minimizing the flow of air from one zone to the other comprising a. first and second bearing members between which the web material passes, said bearing members being built into the gap, the first bearing member comprising a cylindrical roller rotatable about a longitudinal axle and the second bearing member comprising a cylindrical roller rotatable about a longitudinal axle which is parallel to the axle of the first bearing member and which roller comprises a solid cylindrical core the lateral face of which is covered by a layer of compressible material, the distance between the two longitudinal axles being such that the two cylindrical rollers are maintained in contact, b. first sealing means provided between the lateral faces of both bearing members and edges of the gap adjacent thereto, and c. second sealing means provided between the end faces of both bearing members and edges of the gap adjacent thereto said second sealing means comprising a separate wearing member associated with each end face of each said bearing members, each wearing member comprising a cylindrical wear plate having the same diameter as the associated bearing member and having a wearing surface that matches the associated end face and a cylindrical supporting portion of lesser diameter which is a sliding fit within a cylindrical cavity in said wall, both wear plate and supporting portion being mounted concentrically to and surrounding the axle of said associated bearing member, a thin rigid plate which fits into opposed first radial slots in the two adjacent wearing members at each end of the pair of bearing members and into opposed matching slots in said wall, a further two thin rigid plates which fit into second radial slots on the opposite side of each adjacent pair of wearing members from the first radial slots and also into opposed matching slots in the walls surrounding the gap, sealing means between the circumferential surface of said supporting portion and the wall of said cavity which permits movement of said wearing member towards and away from the associated end face of the associated bearing member and at least one spring bearing on the end face of said support portion of each wearing member for biasing said wearing surface of each wearing member into contact with the associated end face of the associated bearing member.

The invention may be better understood by reference to the accompanying drawings which illustrate, by way of example only, a preferred embodiment. The following description relates to these drawings in which FIG. 1 represents a view, partly in section, from the high pressure side, showing two rollers set in a gap, FIG. 2 represents a section through the axis of the two rollers viewed from the same position and FIG. 3 represents a section through the line XX in FIG. 2 viewed in the direction shown.

Figure 2:
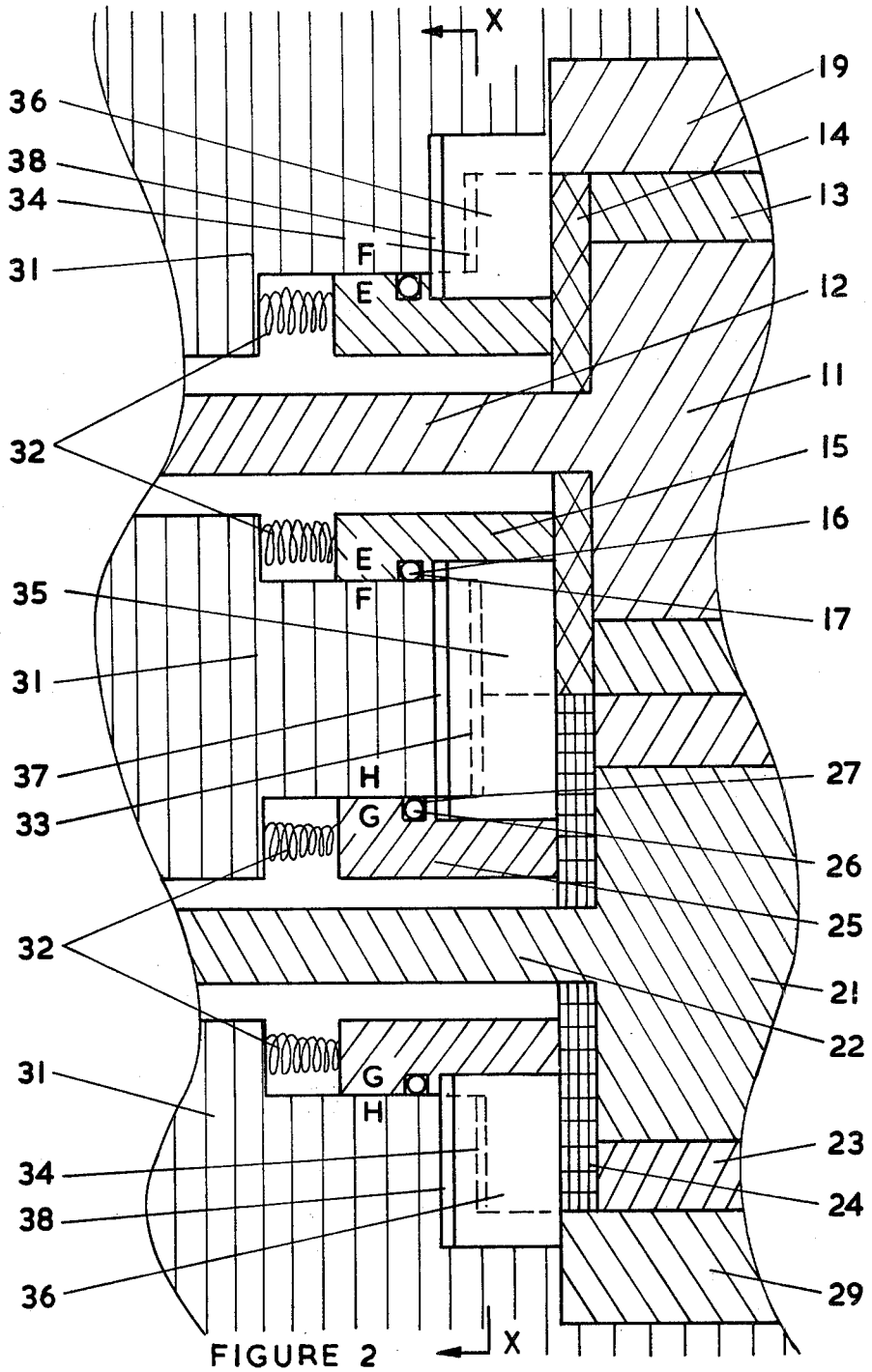
Figure 3:
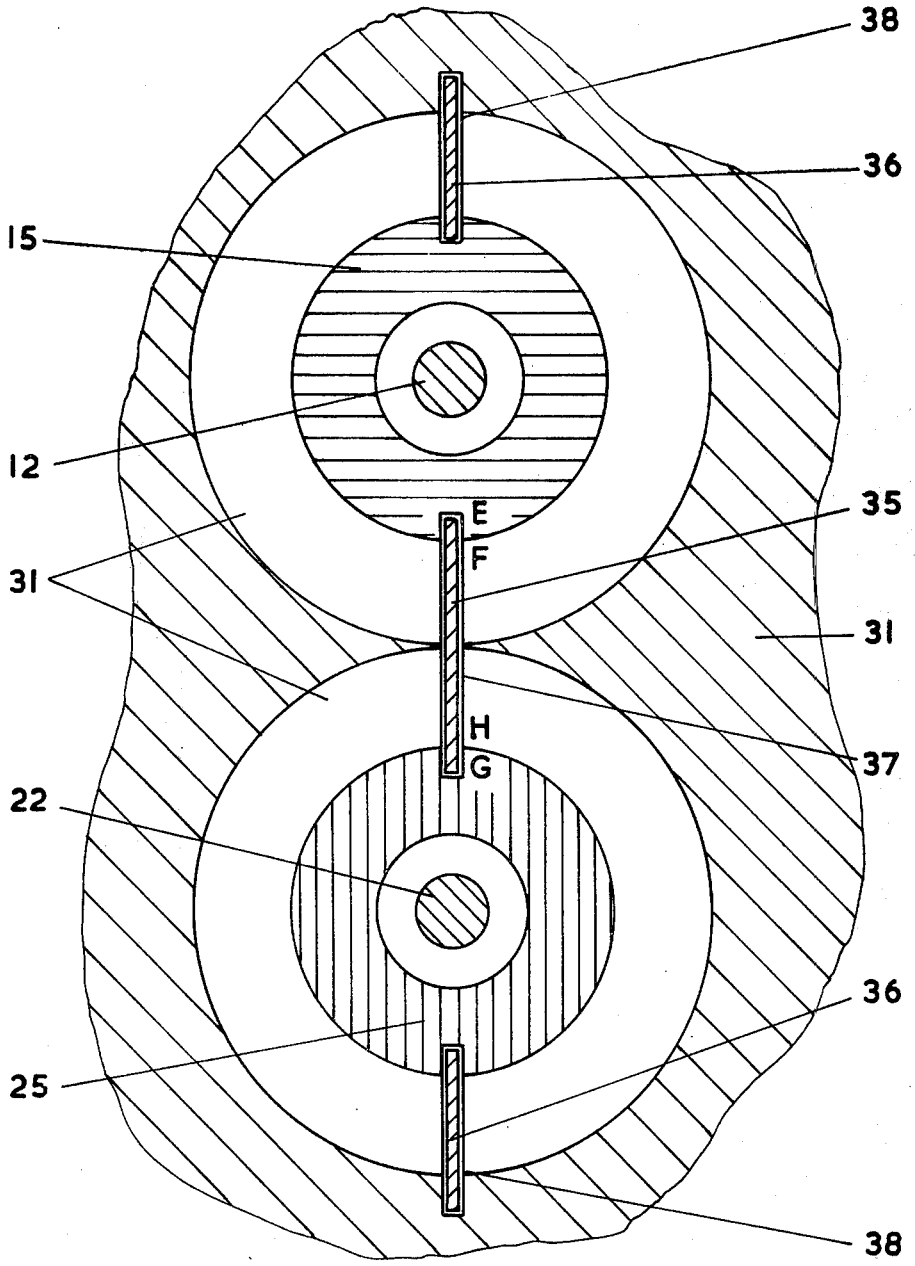

In FIGS. 1 and 2 a rectangular gap in a wall 31 is defined by the lines AB, BC, CD and DA. Two rigid rollers 11, 21 having rigid end plates 14, 24 with machined surfaces are mounted within the gap on axles 12, 22 with their axis substantially parallel to the longitudinal edges AB and CD of the gap. The end plates 14, 24 are of a greater diameter than the rollers 11, 21 and the annular spaces between the end plates 14, 24 are filled by elastomeric coverings 13, 23 which are of a slightly larger diameter than the end plates 14, 24. The rollers 11, 21 are so mounted that the lateral faces of the end plates 14, 24 are maintained in contact whereupon there is a "flat" formed where the elastomeric coverings 13, 23 meet. Both the rollers are driven through the axles 12, 22 by a power source (not shown). Two stepped annular wear members 15, 25, which surround the axles 12, 22 are held against the flat machined surfaces of the end plates 14, 24 by means of springs 32 which bear against the wall 31. The faces of the wear members 15, 25 that are in contact with the end plates 14, 24 are also machined flat so that a good seal can be formed between the faces.

The wear members 15, 25 which are a sliding fit into circular holes cut into the plane of the wall 31 through which the axles 12, 22 also pass are sealed to the wall 31 between the faces E & F and G & H respectively by rubber O rings 16, 26 which are located in annular grooves 17, 27 set into the wear members 15, 25.

The spaces 33, 34 between the wear members 15, 25 and the wall 31 which are shown in FIG. 1 and 2 are sealed by thin rigid plates 35, 36 (see also FIG. 3) which are a sliding fit into coplanar slots 37, 38 (see also FIG. 3) cut into the wear members 15, 25 and the opposed wall 31.

One of the thin plates 35 seals the gap 33 between the wall 31 and the wear members 15, 25 between the rollers 11, 21 while the other two thin plates 36 seal the gaps 34 between the wall 31 and the wear members 15, 25 on the opposite side of the wear members 15, 25 from the first thin plate 35. The two thin plates 36 extend beyond the circumference of the wear members 15, 25.

The substantially rectangular spaces between the lateral faces of the rubber covered rollers 11, 12 and the edges of the gap AB and CD are closed by subsidiary seals 19, 20 which are sealed to the wall 31 on three sides and bear on the lateral faces of the elastomeric covering 13, 23 of the rollers 11, 21 and of the end plates 14, 24. Suitable seals for this purpose are described in our copending U.S. application Ser. No. 475,913.

In operating the apparatus just described the two bearing members are set in motion, a differential pressure is applied across the seal, preferably by reducing the pressure on one side of the apparatus, and the leading edge of a web material is fed between the two rollers 11, 21. The web material is then continuously drawn through the seal by the rotation of the two rollers 11, 21 while only minimal quantities of air pass through the apparatus from the high to the low pressure region.

Because of the pressure differential across the apparatus the thin plates 35, 36 will be held against the low pressure side of the slots 37, 38 as shown in FIG. 3 thus completely sealing the gaps 33, 34 between the wear members 15, 25 and the opposing wall 31.

This arrangement permits independent movement of each of the wear plates in a direction along the axis of the roller with which each is in contact whilst maintaining a substantially airtight seal.

We claim:

1. An improved sealing apparatus for permitting the continuous passage of a web material through a gap in a wall separating two zones at different pressures while minimizing the flow of air from one zone to the other comprising a. first and second bearing members between which the web material passes, said bearing members being built into the gap, the first bearing member comprising a cylindrical roller rotatable about a longitudinal axle and the second bearing member comprising a cylindrical roller rotatable about a longitudinal axle which is parallel to the axle of the first bearing member and which roller comprises a solid cylindrical core the lateral face of which is covered by a layer of compressible material, the distance between the two longitudinal axles being such that the two cylindrical rollers are maintained in contact, b. first sealing means provided between the lateral faces of both bearing members and edges of the gap adjacent thereto, and c. second sealing means provided between the end faces of both bearing members and edges of the gap adjacent thereto said second sealing means comprising a separate wearing member associated with each end face of each said bearing members, each wearing member comprising a cylindrical wear plate having the same diameter as the associated bearing member and having a wearing surface that matches the associated end face and a cylindrical supporting portion of lesser diameter which is a sliding fit within a cylindrical cavity in said wall, both wear plate and supporting portion being mounted concentrically to and surrounding the axle of said associated bearing member, a thin rigid plate which fits into opposed first radial slots in the two adjacent wearing members at each end of the pair of bearing members and into opposed matching slots in said wall, a further two thin rigid plates which fit into second radial slots on the opposite side of each adjacent pair of wearing members from the first radial slots and also into opposed matching slots in the walls surrounding the gap, sealing means between the circumferential surface of said supporting portion and the wall of said cavity which permits movement of said wearing member towards and away from the associated end face of the associated bearing member and at least one spring bearing on the end face of said support portion of each wearing member for biasing said wearing surface of each wearing member into contact with the associated end face of the associated bearing member.

* * * * *